US010595572B2

(12) United States Patent
Pascarelli

(10) Patent No.: US 10,595,572 B2
(45) Date of Patent: Mar. 24, 2020

(54) SHOWER GARMENT

(71) Applicant: Jeanmarie Pascarelli, Hanover, MA (US)

(72) Inventor: Jeanmarie Pascarelli, Hanover, MA (US)

( * ) Notice: Subject to any disclaimer, the term of this patent is extended or adjusted under 35 U.S.C. 154(b) by 148 days.

(21) Appl. No.: 15/878,510

(22) Filed: Jan. 24, 2018

(65) Prior Publication Data

US 2019/0223523 A1 Jul. 25, 2019

(51) Int. Cl.

| | |
|---|---|
| ***A41D 7/00*** | (2006.01) |
| ***A47K 7/04*** | (2006.01) |
| ***A47K 7/08*** | (2006.01) |
| ***A47K 7/02*** | (2006.01) |

(52) U.S. Cl.

CPC ..... *A41D 7/00* (2013.01); *A47K 7/022* (2013.01); *A47K 7/043* (2013.01); *A47K 7/08* (2013.01); *A41D 2300/32* (2013.01)

(58) Field of Classification Search

CPC ..... A41D 7/00; A41D 2300/32; A47K 7/043; A47K 7/022; A47K 7/08

See application file for complete search history.

(56) References Cited

U.S. PATENT DOCUMENTS

| | | | | |
|---|---|---|---|---|
| 2,757,384 | A | 8/1956 | Slater | |
| 5,013,171 | A * | 5/1991 | Almond, II | A47K 7/022 15/222 |
| 5,253,642 | A * | 10/1993 | Stackhouse | A41D 13/11 128/201.25 |
| 5,386,609 | A * | 2/1995 | Xenos | A47K 7/022 15/222 |
| 6,230,329 | B1 * | 5/2001 | Jennings | A41D 13/1245 2/114 |
| 6,374,415 | B1 | 4/2002 | Lenart | |
| 7,509,689 | B2 | 3/2009 | Reardon et al. | |
| D626,722 | S | 11/2010 | Macke et al. | |
| 8,141,173 | B2 | 3/2012 | Sterling | |
| 8,745,766 | B2 | 6/2014 | Tarrant et al. | |
| 2013/0007941 | A1 | 1/2013 | Smith et al. | |
| 2013/0305446 | A1 | 11/2013 | Smith et al. | |

* cited by examiner

*Primary Examiner* — Khaled Annis

(57) ABSTRACT

A shower garment for providing scrubbing and privacy while showering includes a shell that is meshed so that the shell is configured to allow water to enter and to exit. The shell is flexible and has a bottom that is open. A pair of first holes is positioned in the shell proximate to a top of the shell. A second hole is positioned in the top of the shell between the first holes. The shell is configured to position a body of a user with a head and arms extending through the second hole and first holes, respectively. The shell covers a torso and a pelvic region of the user. A plurality of scrubbers that is selectively couplable to an inner surface of the shell is configured to scrub the user and to screen the user's breasts, genitals, and buttocks from viewing by persons proximate to the user.

6 Claims, 5 Drawing Sheets

SHOWER GARMENT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to garments and more particularly pertains to a new garment for providing scrubbing and privacy while showering.

BRIEF SUMMARY OF THE INVENTION

An embodiment of the disclosure meets the needs presented above by generally comprising a shell that is meshed so that the shell is configured to allow water to enter and to exit. The shell is flexible and has a bottom that is open. A pair of first holes is positioned in the shell proximate to a top of the shell. A second hole is positioned in the top of the shell between the first holes. The shell is configured to position a body of a user with a head and arms extending through the second hole and first holes, respectively. The shell covers a torso and a pelvic region of the user. A plurality of scrubbers that is selectively couplable to an inner surface of the shell is configured to scrub the user and to screen the user's breasts, genitals, and buttocks from viewing by persons proximate to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
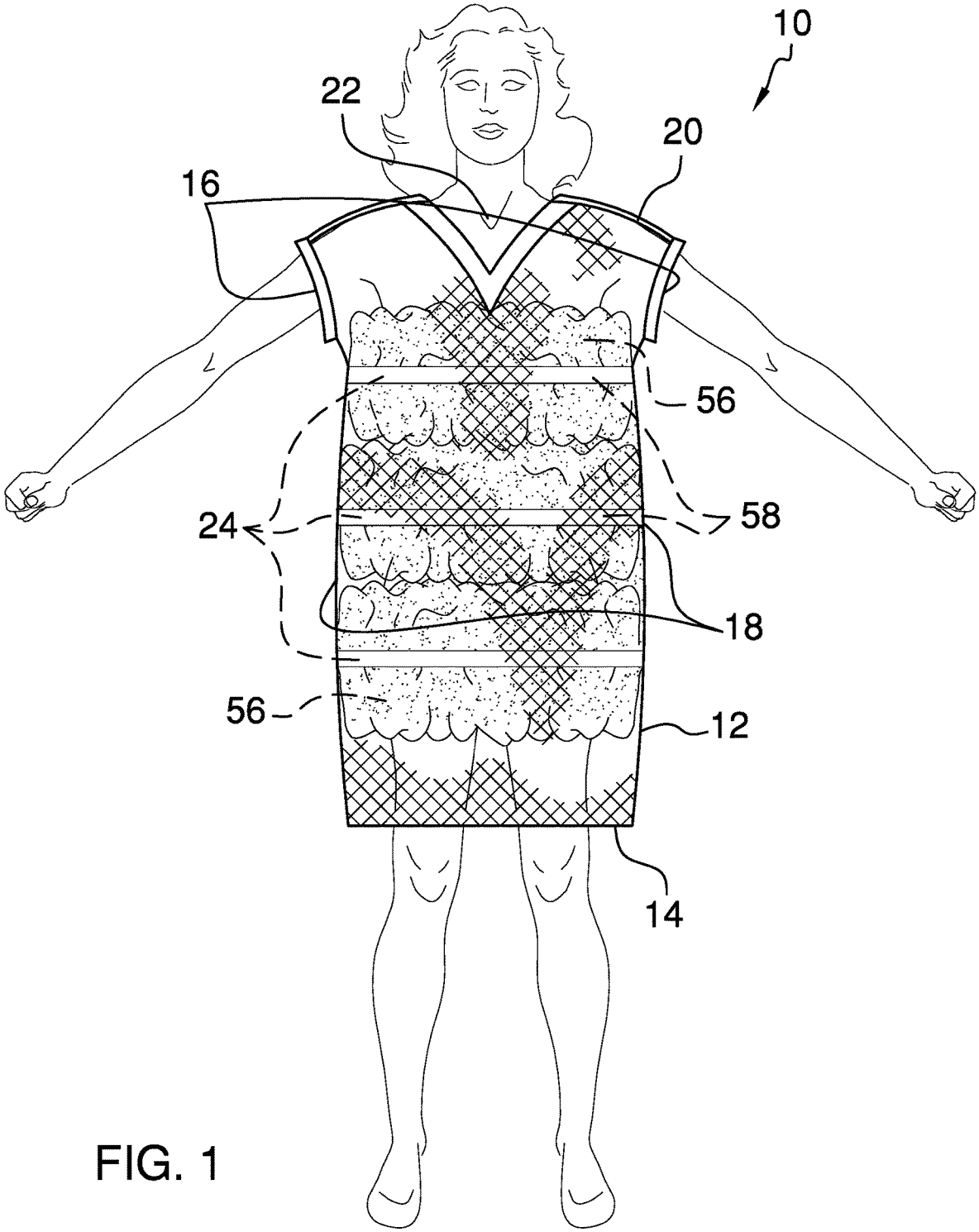
FIG. 1 is a front view of a shower garment according to an embodiment of the disclosure.

With reference now to the drawings, and in particular to FIGS. 1 through 6 thereof, a new garment embodying the principles and concepts of an embodiment of the disclosure and generally designated by the reference numeral 10 will be described.

As best illustrated in FIGS. 1 through 6, the shower garment 10 generally comprises a shell 12 that is meshed so that the shell 12 is configured to allow water to enter and to exit the shell 12. The shell 12 is flexible and has a bottom 14 that is open.

A pair of first holes 16 is positioned singly in opposing sides 18 of the shell 12 proximate to a top 20 of the shell 12. A second hole 22 is positioned in the top 20 of the shell 12 equally distant from the first holes 16. The shell 12 is configured to position a body of a user with a head of the user extending through the second hole 22 and with each arm of the user extending through a respective first hole 16. The shell 12 covers a torso and a pelvic region of the body of the user.

A plurality of first couplers 24 is coupled to an inner surface 26 of the shell 12. The plurality of first coupler 24 comprises a plurality of first bands 28. Each first band 28 extends around a circumference 30 of the shell 12. The plurality of first bands 28 comprises a lower band 32 that is positioned on the shell 12 so that the lower band 32 is positioned proximate to the pelvic region of the user when the shell 12 is positioned on the user. The plurality of first bands 28 comprises an upper band 34 that is positioned on the shell 12 so that the upper band 34 is positioned proximate to a breast region of the user when the shell 12 is positioned on the user. The plurality of first bands 28 also comprises a medial band 36 that is positioned substantially equally distant from the upper band 34 and the lower band 32.

Figure 2:
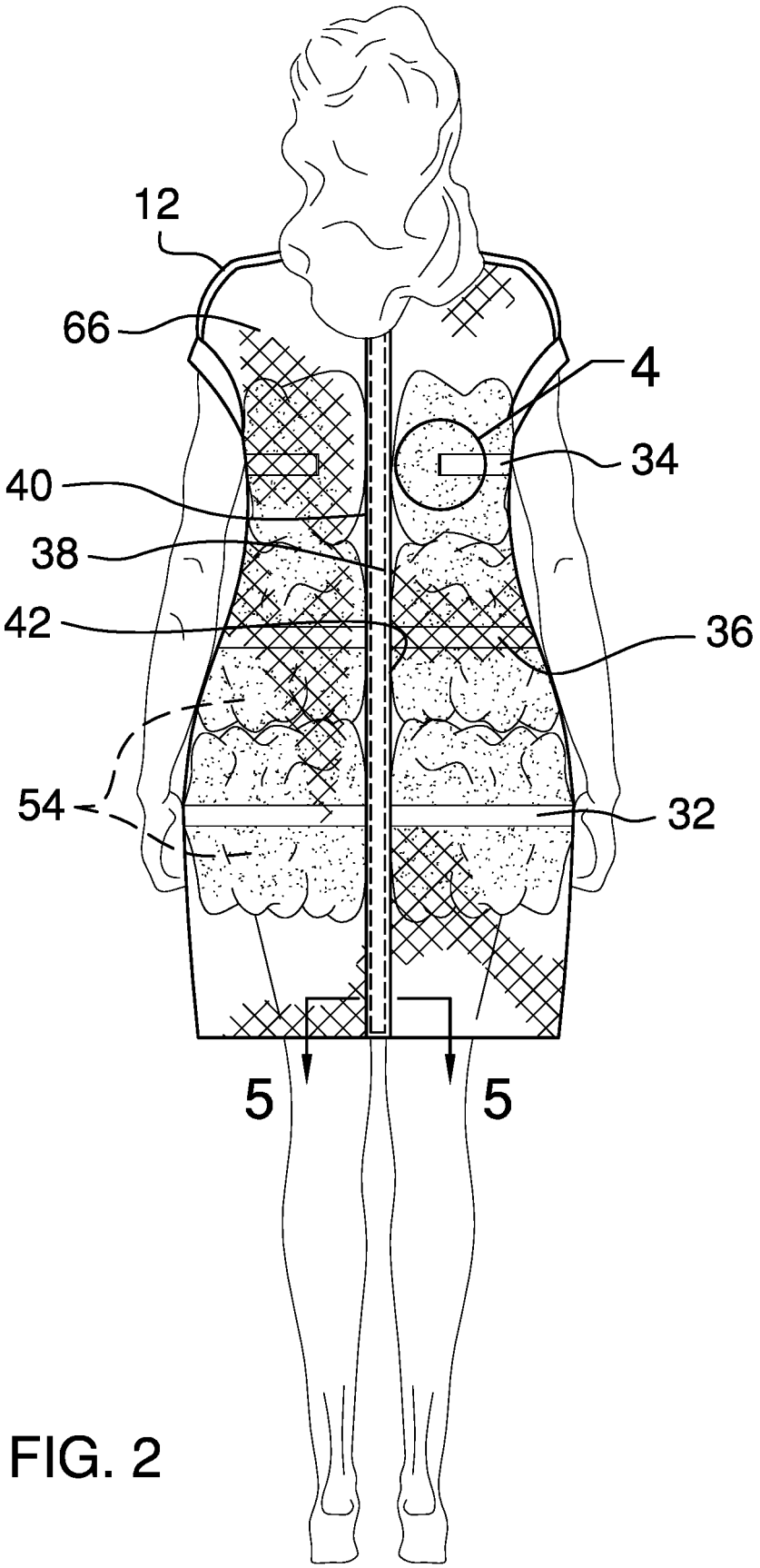
FIG. 2 is a back view of an embodiment of the disclosure.
Figure 3:
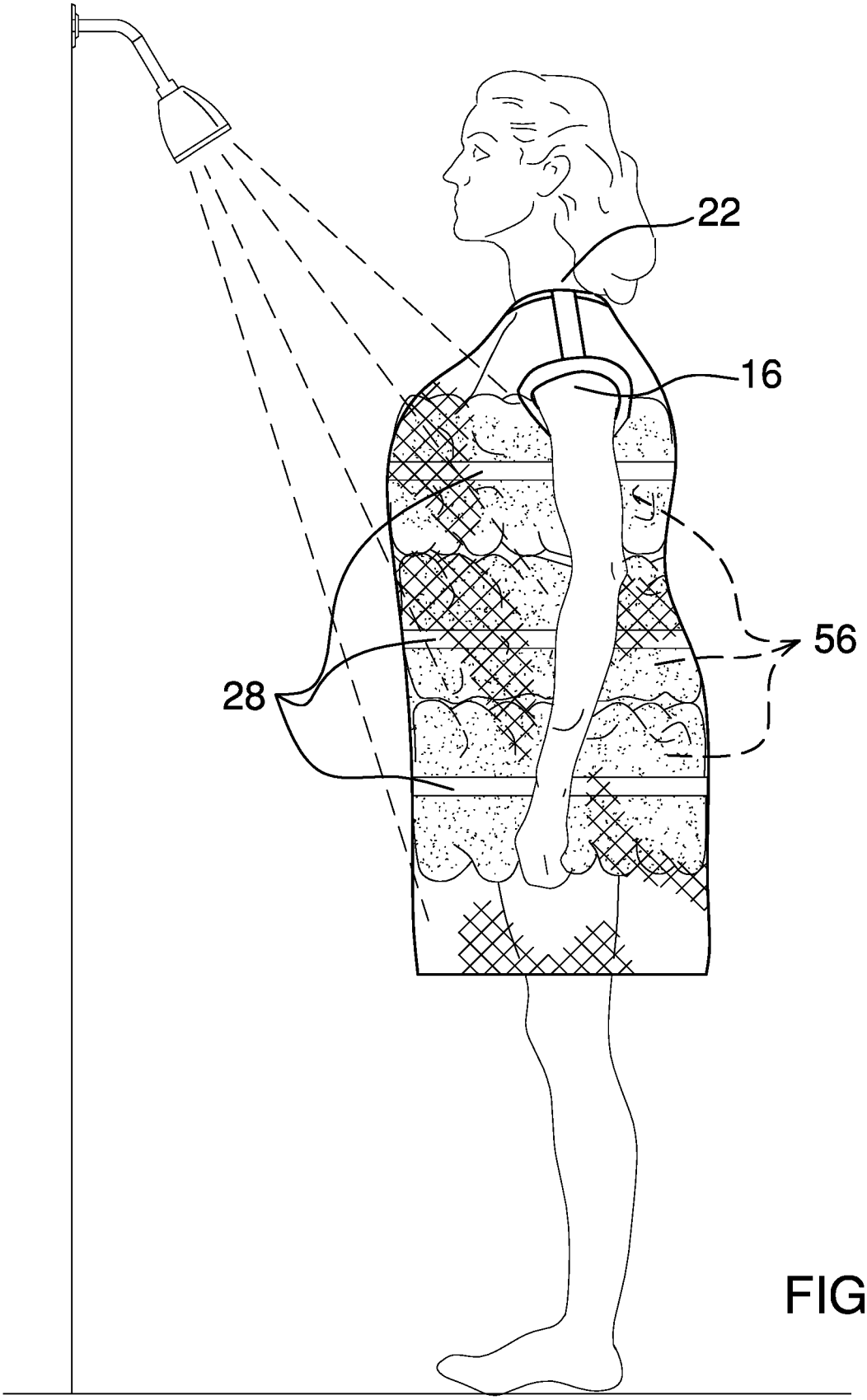
FIG. 3 is a side view of an embodiment of the disclosure.

A slit 38 is positioned in a back 66 of the shell 12, as shown in FIG. 2. The slit 38 extends from the second hole 22 to the bottom 14 of the shell 12 and defines a first edge 40 and a second edge 42 of the shell 12. In this respect, the shell 12 is similar to a hospital gown and allows the shell 12 to be readily positioned on the user by a caregiver.

A first connector 44 is coupled to the first edge 40 of the shell 12. A second connector 46 is coupled to the second edge 42 of the shell 12. The second connector 46 is complementary to the first connector 44. The second connector 46 is positioned to selectively couple to the first connector 44 to couple the second edge 42 to the first edge 40 to close the shell 12 around the body of the user.

Figure 5:
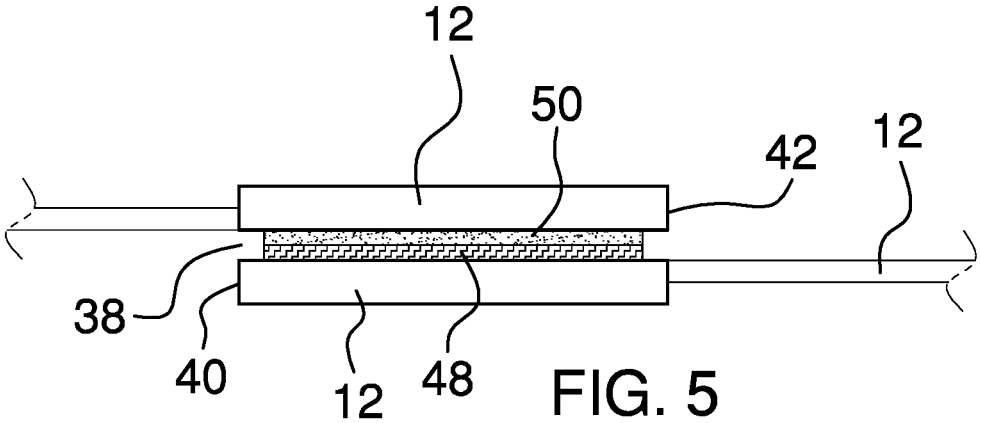
FIG. 5 is a cross-sectional view of an embodiment of the disclosure.
Figure 6:
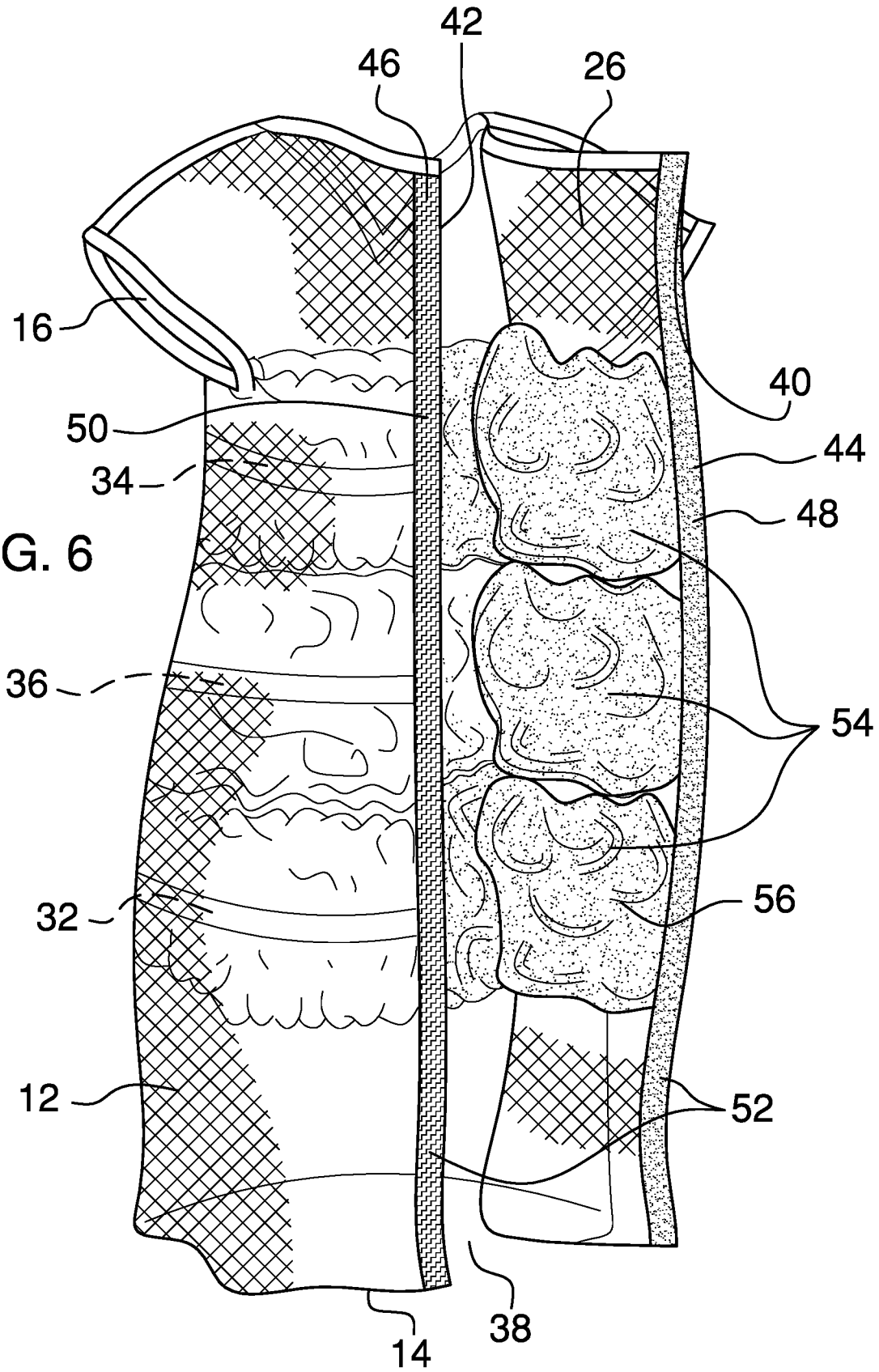
FIG. 6 is an isometric perspective view of an embodiment of the disclosure.

The first connector 44 comprises a first strip 48 and the second connector 46 comprises a second strip 50. The first strip 48 and the second strip 50 extend from proximate to the second hole 22 to proximate to the bottom 14 of the shell 12. The second strip 50 and the first strip 48 comprise a first hook and loop fastener 52, as shown in FIGS. 5 and 6.

A plurality of scrubbers 54 is selectively couplable to the inner surface 26 of the shell 12. The scrubbers 54 are configured to scrub the body of the user and to screen breasts, genitals, and buttocks of the user from viewing by persons proximate to the user. Each scrubber 54 comprises a loofah 56 or the like.

Each of a plurality of second couplers 58 is coupled to a respective scrubber 54. The second couplers 58 are complementary to the first couplers 24. Each second coupler 58 is positioned to couple to a respective first coupler 24 to couple the respective scrubber 54 to the inner surface 26 of the shell 12.

Figure 4:
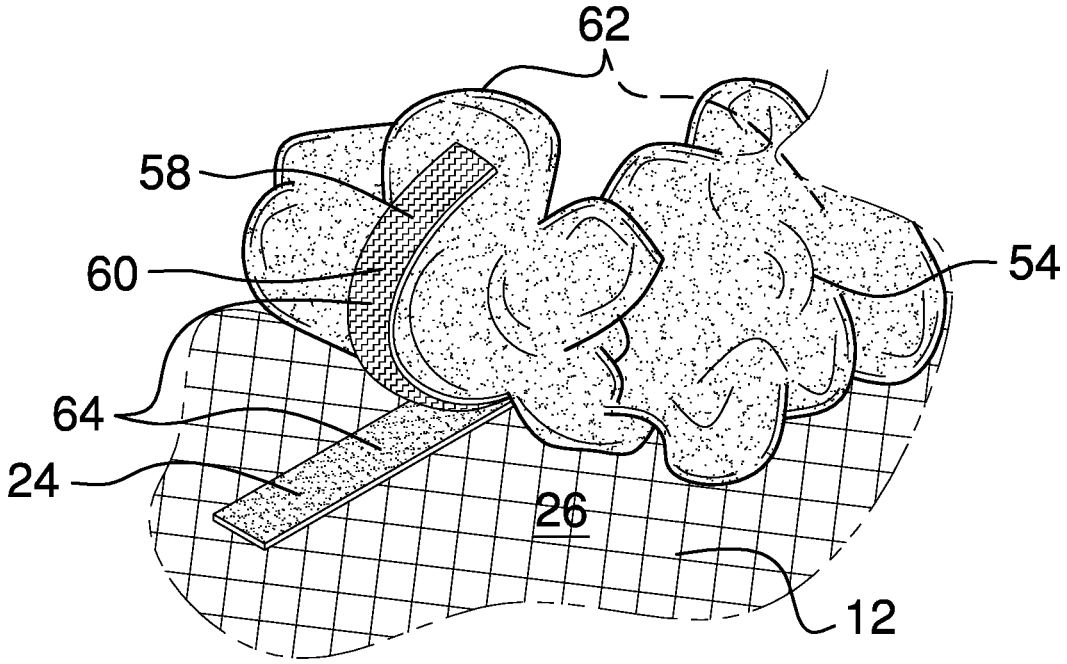
FIG. 4 is a detail view of an embodiment of the disclosure.

Each second coupler 58 comprises a second band 60. The second band 60 extends from proximate to opposing ends 62 of the respective scrubber 54. The second band 60 is positioned to couple to a respective first band 28 so that the respective scrubber 54 is selectively positionable on the inner surface 26 of the shell 12. Each second band 60 and the respective first band 28 comprises a second hook and loop fastener 64, as shown in FIG. 4.

In use, the scrubbers 54 that are positioned on the shell 12 are configured to scrub the body of the user while the user is showering. The scrubbers 54 also screen the breasts, the genitals, and the buttocks of the user from viewing by the persons proximate to the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shower garment comprising:

a shell, said shell being meshed such that said shell is configured for water entering and exiting said shell, said shell being flexible, said shell having a bottom, said bottom being open;

a pair of first holes positioned singly in opposing sides of said shell proximate to a top of said shell;

a second hole positioned in said top of said shell equally distant from said first holes such that said shell is configured for positioning a body of a user with a head of the user extending through said second hole and with each arm of the user extending through a respective first hole such that said shell is adapted to cover a torso and a pelvic region of the body of the user;

a plurality of scrubbers selectively couplable to an inner surface of said shell;

wherein said scrubbers are positioned on said shell such that said scrubbers are configured for scrubbing the body of the user and for screening breasts, genitals, and buttocks of the user from viewing by persons proximate to the user;

a plurality of first couplers coupled to said inner surface of said shell, said plurality of first coupler comprising a plurality of first bands, each said first band extending around a circumference of said shell; and a plurality of second couplers, said second couplers being complementary to said first couplers, each said second coupler comprising a second band, said second band extending from proximate to opposing ends of said respective said scrubber, each said second coupler being coupled to a respective said scrubber, wherein said second couplers are positioned on said scrubbers such that each said second coupler is positioned for coupling to a respective said first coupler for coupling said respective said scrubber to said inner surface of said shell, each said second band and said respective said first band comprising a second hook and loop fastener, wherein said second band is positioned on said scrubber such that said second band is positioned for coupling to a respective said first band such that said respective said scrubber is selectively positionable on said inner surface of said shell.

2. The garment of claim 1, further including each said scrubber comprising a loofah.

3. The garment of claim 1, further comprising:

a slit positioned in a back of said shell, said slit extending from said second hole to said bottom of said shell defining a first edge and a second edge of said shell;

a first connector coupled to said first edge of said shell;

a second connector coupled to said second edge of said shell, said second connector being complementary to said first connector; and wherein said second connector is positioned on said second edge of said shell such that said second connector is positioned for selectively coupling to said first connector for coupling said second edge to said first edge for closing said shell around the body of the user.

4. The garment of claim 3, further comprising:

said first connector comprising a first strip extending from proximate to said second hole to proximate to said bottom of said shell;

said second connector comprising a second strip extending from proximate to said second hole to proximate to said bottom of said shell; and said second strip and said first strip comprising a first hook and loop fastener.

5. The garment of claim 1, further including said plurality of first bands comprising:

a lower band positioned on said shell such that said lower band is adapted to be positioned proximate to the pelvic region of the user when said shell is positioned on the user;

an upper band positioned on said shell such that said upper band is adapted to be positioned proximate to a breast region of the user when said shell is positioned on the user; and a medial band positioned substantially equally distant from said upper band and said lower band.

6. A shower garment comprising:

a shell, said shell being meshed such that said shell is configured for water entering and exiting said shell, said shell being flexible, said shell having a bottom, said bottom being open;

a pair of first holes positioned singly in opposing sides of said shell proximate to a top of said shell;

a second hole positioned in said top of said shell equally distant from said first holes such that said shell is configured for positioning a body of a user with a head of the user extending through said second hole and with each arm of the user extending through a respective first hole such that said shell is adapted to cover a torso and a pelvic region of the body of the user;

a plurality of first couplers coupled to an inner surface of said shell, said plurality of first coupler comprising a plurality of first bands, each said first band extending around a circumference of said shell, said plurality of first bands comprising a lower band positioned on said shell such that said lower band is adapted to be positioned proximate to the pelvic region of the user when said shell is positioned on the user, an upper band positioned on said shell such that said upper band is adapted to be positioned proximate to a breast region of the user when said shell is positioned on the user, and a medial band positioned substantially equally distant from said upper band and said lower band;

a slit positioned in a back of said shell, said slit extending from said second hole to said bottom of said shell defining a first edge and a second edge of said shell;

a first connector coupled to said first edge of said shell, said first connector comprising a first strip extending from proximate to said second hole to proximate to said bottom of said shell;

a second connector coupled to said second edge of said shell, said second connector being complementary to said first connector, wherein said second connector is positioned on said second edge of said shell such that said second connector is positioned for selectively coupling to said first connector for coupling said second edge to said first edge for closing said shell around the body of the user, said second connector comprising a second strip extending from proximate to said second hole to proximate to said bottom of said shell, said second strip and said first strip comprising a first hook and loop fastener;

a plurality of scrubbers selectively couplable to said inner surface of said shell, wherein said scrubbers are positioned on said shell such that said scrubbers are configured for scrubbing the body of the user and for screening breasts, genitals, and buttocks of the user from viewing by persons proximate to the user, each said scrubber comprising a loofah;

a plurality of second couplers, said second couplers being complementary to said first couplers, each said second coupler being coupled to a respective said scrubber, wherein said second couplers are positioned on said scrubbers such that each said second coupler is positioned for coupling to a respective said first coupler for coupling said respective said scrubber to said inner surface of said shell, each said second coupler comprising a second band, said second band extending from proximate to opposing ends of said respective said scrubber, wherein said second band is positioned on said scrubber such that said second band is positioned for coupling to a respective said first band such that said respective said scrubber is selectively positionable on said inner surface of said shell, each said second band and said respective said first band comprising a second hook and loop fastener; and wherein said scrubbers are positioned on said shell such that said scrubbers are configured for scrubbing the body of the user and for screening the breasts, the genitals, and the buttocks of the user from viewing by the persons proximate to the user.

* * * * *